US006920912B2

(12) United States Patent
Blejde et al.

(10) Patent No.: US 6,920,912 B2
(45) **Date of Patent: *Jul. 26, 2005**

(54) CASTING STEEL STRIP

(75) Inventors: Walter N. Blejde, Brownsburg, IN (US); Andrew Glutz, Figtree (AU)

(73) Assignee: Nucor Corporation, Charlotte, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/411,846

(22) Filed: Apr. 11, 2003

(65) Prior Publication Data

US 2004/0123973 A1 Jul. 1, 2004

Related U.S. Application Data

(63) Continuation-in-part of application No. 10/121,567, filed on Apr. 12, 2002, now Pat. No. 6,776,218, which is a continuation-in-part of application No. PCT/AU00/01478, filed on Nov. 30, 2000.

(30) Foreign Application Priority Data

Nov. 30, 1999 (AU) ..... PQ4362

(51) Int. Cl.[7] ..... B22D 11/12

(52) U.S. Cl. ..... 164/475; 164/480; 164/415; 164/428

(58) Field of Search ..... 164/475, 480, 164/415, 428, 479, 486, 429, 443

(56) References Cited

U.S. PATENT DOCUMENTS

| | | | | |
|---|---|---|---|---|
| 3,848,656 A | | 11/1974 | Meylan | |
| 4,000,771 A | | 1/1977 | Williamson | |
| 4,211,272 A | * | 7/1980 | Schrewe et al. | 164/486 |
| 4,658,882 A | | 4/1987 | Oba et al. | |
| 5,657,814 A | | 8/1997 | Maebara et al. | |
| 5,816,311 A | * | 10/1998 | Osada et al. | 164/415 |
| 5,901,777 A | | 5/1999 | Matsumura et al. | |
| 5,904,204 A | | 5/1999 | Teraoka et al. | |
| 6,776,218 B2 | * | 8/2004 | Glutz et al. | 164/475 |

FOREIGN PATENT DOCUMENTS

| | | | |
|---|---|---|---|
| JP | 358202958 A | | 11/1983 |
| JP | 362077151 A | | 4/1987 |
| JP | 05068525 A | * | 3/1993 |
| JP | 5-68525 | | 9/1993 |

* cited by examiner

*Primary Examiner*—Kevin P. Kerns
(74) *Attorney, Agent, or Firm*—Hahn Loeser & Parks LLP

(57) ABSTRACT

Roll caster (11) produces thin steel strip (12) formed on casting surfaces (22A) of casting roll (22) that passes through first enclosure (37) adjacent casting roll surfaces (22A) and, optionally, thereafter second enclosure (61). Enclosure (37) and/or enclosure (61) may be fitted with spray nozzles (71,72) and/or (67, 68) operable to spray fine water mist adjacent strip (12) to produce hydrogen gas in enclosure (37) while tending to avoid liquid water contact with steel strip (12) and casting surfaces (22A). If hydrogen gas is produced only in enclosure (61), the two enclosures (37, 61) are interconnected so that gas can flow from enclosure (61) to enclosure (37). Enclosure (37) and, if present, enclosure (61) are sealed to maintain positive pressure and oxygen levels less than the surrounding atmosphere, and with the presence of hydrogen gas, reduce formation of scale on the strip in enclosure (37) and, if present, enclosure (61).

31 Claims, 7 Drawing Sheets

CASTING STEEL STRIP

RELATED APPLICATIONS

This application is a continuation-in-part of application Ser. No. 10/121,567, filed Apr. 12, 2002 now U.S. Pat. No. 6,776,218, which is a pending continuation-in-part application of International Application PCT/AU00/01478 filed Nov. 30, 2000, which application claims priority to Australian Provisional Patent Application No. PQ4362, filed Nov. 30, 1999.

BACKGROUND

This invention relates to continuous casting of steel strip in a strip caster, particularly a twin roll caster.

In a twin roll caster, molten metal is introduced between a pair of counter-rotated horizontal casting rolls which are internally cooled so that metal shells solidify on the moving roll surfaces and are brought together at the nip between them to produce a solidified strip product delivered downwardly from the nip. The term "nip" is used herein to refer to the general region at which the casting rolls are closest together. The molten metal may be poured from a ladle into a smaller vessel from which molten metal flows through a metal delivery nozzle located above the nip, forming a casting pool of molten metal supported on the casting surfaces of the rolls immediately above the nip and extending along the length of the nip. This casting pool is usually confined between side plates or dams held in sliding engagement with end surfaces of the casting rolls to dam the two ends of the casting pool against outflow, although alternative means such as electromagnetic barriers have also been proposed.

When casting steel strip in a twin roll caster, the strip leaves the nip at very high temperatures of the order of 1400° C. and can suffer very rapid scaling due to oxidation at such high temperatures. Such scaling may result in a significant loss of steel product. For example, 3% of a 1.55 mm thick strip (typical scale thickness 23 microns) can be lost from oxidation as the strip cools. Moreover, such scaling results in the need to descale the strip prior to further processing by pickling to avoid surface quality problems such as rolled-in scale, and causes significant extra complexity, cost and environmental concerns. For example, the hot strip material may be passed directly to a rolling mill in line with the strip caster and thence to a run out table on which it is cooled to coiling temperature before it is coiled. However, scaling of the hot strip material emerging from the strip caster progresses so rapidly that it may be necessary to install descaling equipment to descale the material immediately before it enters the in line rolling mill. Even in cases when the strip is cooled to coiling temperature without hot rolling, it will generally be necessary to descale the strip either before it is coiled or in a later processing step.

To deal with the problem of rapid scaling of strip emerging from a twin roll strip caster, it has been proposed to enclose the newly formed strip within a sealed enclosure, or a succession of such sealed enclosures, in which a controlled atmosphere or atmospheres is maintained in order to inhibit oxidation of the cast strip. The controlled atmosphere can be produced by charging the sealed enclosure or successive enclosures with non-oxidizing gases. Such gases can be inert gases such as nitrogen or argon or exhaust gases from fuel burners.

U.S. Pat. No. 5,762,126 discloses an alternative relatively cheap and energy efficient way of limiting exposure of the high temperature strip to oxygen. The strip is caused to pass through an enclosure where oxygen is extracted from the atmosphere by the formation of scale. The enclosure is substantially sealed so as to control the ingress of oxygen into the enclosure atmosphere and control the extent of scale formation. In this method of operation, it is possible to rapidly reach a steady state condition in which scale formation is brought to low levels without the need to deliver a non-oxidizing or reducing gas into the enclosure.

U.S. Pat. No. 5,816,311 discloses a way of controlling the extent of scale formation by providing downstream a chamber where groups of nozzles spray a quenching medium onto the strip. The quenching medium was a methyl alcohol, water, or mixture of methyl alcohol and another quenching medium liquid at room temperature. It was expected that water spraying in a nitrogen atmosphere would lead to unacceptable levels of oxidation as water contains dissolved oxygen and the breakdown of water (steam) to oxygen and hydrogen would provide further oxidation; however, it was surprisingly and unexpectedly found as described in the '311 patent that it was possible to limit the thickness of oxide on the strip to no more than 0.5 microns. Additionally, it was surprisingly found that these levels of oxide were tolerable for cold rolling without pickling and then metal coating of the strip. This quenching of the steel strip was found, however, to result in uneven cooling of the steel strip introducing stresses and other defects in the strip.

International Patent Application PCT/AU00/01478, on which parent application Ser. No. 10/121,567 is based, discloses how a substantially non-oxidizing atmosphere can be cheaply and effectively produced within a downstream enclosure, through which the hot cast steel strip passes, by introducing water in a fine mist spray to generate steam within the enclosure. The steam generation increases the gaseous volume within the enclosure so as to produce a positive pressure in the enclosure which substantially prevents the ingress of atmospheric air. It can also produce an increased level of hydrogen gas within the enclosure to significantly reduce the oxygen level in the enclosure and reduce the rate of oxidation of the strip. In the disclosure of International Application PCT/AU00/01478 it was considered necessary to isolate the enclosure in which steam is generated from the enclosure to which the casting rolls are exposed so as to avoid the risk of exposure of the casting pool to water or steam. We have now found, surprisingly, that by the introduction of water in a fine mist spray, the conversion of the water to steam and the production of hydrogen gas is so effective that it is possible to generate increased levels of hydrogen gas in an enclosure to which the casting rolls are exposed, either by allowing communication with gas flow between that enclosure and the downstream enclosure into which the fine mist spray is introduced and/or by direct introduction of a fine mist spray into the enclosure to which the casting rolls are exposed. By direct introduction of the fine mist spray into the enclosure to which the casting rolls are exposed, it is also possible to omit the separate downstream enclosure.

SUMMARY OF THE INVENTION

The present invention provides a method of continuously casting steel comprising:

(a) forming a casting pool of molten steel on chilled casting surfaces of at least one casting roll;

(b) moving the chilled casting surfaces to produce a solidified steel strip moving away from the casting pool;

(c) guiding the solidified strip through first enclosure adjacent the casting roll surfaces, and optionally thereafter second enclosure, as it moves away from the casting pool;

(d) sealing the first enclosure and, if present, the second enclosures against ingress of atmospheric air separately or with an intercommunication between said enclosures permitting gas flow from the second enclosure to the first enclosure; and (e) introducing water into at least one of said enclosures in form of a fine mist to produce an increased level of hydrogen gas within the first enclosure while tending to avoid liquid water contact with the steel strip and the casting surfaces of the casting roll or rolls.

A "fine mist" herein is a water spray where, in general, the water evaporates and is converted to steam before reaching the surface of the strip. There may still be the odd water droplets that reach the strip, but the intention is to avoid contact of the liquid water with the strip. Too much liquid water on the strip can cause uneven cooling of the strip. The precise droplet size and range of sizes of the water in the fine mist will be dependent on the temperature of the strip in the enclosure where the fine mist is sprayed, and the location of the spray nozzles within the enclosure and their distance from the strip. Notably, the location in relation to the droplet size and range is sensitive where the fine mist is sprayed in the first enclosure to avoid contact of the liquid water with the casting surfaces of the casting roll or rolls. The droplet size and range of the fine mist should be selected for the particular embodiment according to the geometry to provide flexibility in operation, and for the generation hydrogen gas while avoiding contact of the liquid water with the strip and the casting surfaces.

The step of introducing water in the form of fine mist to generate steam also produces a positive pressure in the enclosure where it is introduced, namely, either the first enclosure and the second enclosure. However, if the fine water mist is sprayed into the second enclosure, and not into the first enclosure, the first and second enclosures are directly interconnected or spaced from each other by one or more chambers, with a passageway therebetween, through which gas can flow from the second enclosure to the first enclosure. This passageway may be the same or a different passageway from the passageway through which the cast strip moves from the first enclosure to the second enclosure. In any event, the sealing of the first enclosure and/or the second enclosures need not be complete, but only sufficient to provide a positive atmosphere within the first enclosure, and if present the second enclosure, with a reduced level of oxygen and an increased level of hydrogen gas in relation to the external atmosphere.

In an embodiment where the fine mist is sprayed into the second enclosure to produce hydrogen gas therein and flows into the first enclosure through a connecting passageway, water may in addition be introduced into the first enclosure in form of a fine mist to generate steam therein and to increase the level of hydrogen gas therein while tending to avoid liquid water contact with the steel strip and the chilled casting surfaces of the casting roll or rolls.

In an alternative embodiment, the first enclosure and the second enclosure may be separately sealed against ingress of atmospheric air, and water may be introduced into the first enclosure in form of a fine mist to produce an increased level of hydrogen gas therein while tending to avoid liquid water contact with the steel strip and the casting surfaces of the casting roll or rolls. Such water introduced as a fine mist also generates steam within the first enclosure to produce a positive pressure therein and avoid egress of atmospheric air into the first enclosure. In this embodiment, water may additionally be introduced into the second enclosure in form of a fine mist to produce an increased level of hydrogen gas and/or to generate steam producing a positive pressure therein, while tending to avoid liquid water contact with the steel strip.

In any embodiment, the cast strip may be guided through the first enclosure and into the second enclosure on a transit path through said connecting passageway. Alternatively, the strip may be guided from the first enclosure into the second enclosure along a transit path through a second passageway and/or through a connecting chamber or chambers separated from said first passageway through which gas flows between the enclosures.

The invention further provides apparatus for casting steel strip comprising:

(a) a pair of generally horizontal-positioned casting rolls forming a nip between them;

(b) metal delivery system to deliver molten steel above the nip between the casting rolls to form a casting pool of molten steel supported on the rolls;

(c) a cooling system to chill the casting rolls;

(d) a drive system to counter-rotate the casting rolls in opposite directions;

(e) said casting rolls having chilled casting surfaces to produce a cast strip delivered downwardly from the nip;

(f) a first enclosure adjacent the casting rolls through which the cast strip passes on a transit path away from the nip;

(g) optionally a second enclosure through which the cast strip passes after the strip has passed through the first enclosure;

(h) enclosure seals sealing the first enclosure and, if present, second enclosures separately or with an intercommunication between the first and second enclosures permitting flow of gas between said enclosures; and (i) one or more water sprays operable to spray water in form of a fine mist into at least one of said enclosures to produce an increased level of hydrogen gas within the first enclosure while tending to avoid liquid water contact with the steel strip and the casting surfaces of the casting rolls.

The fine mist water spray further may generate steam within one or both of the first and second enclosures.

The apparatus for casting steel strip also may have strip guides to guide the strip delivered downwardly from the nip through a transit path in the first enclosure and through a transit path in the second enclosure.

The first enclosure and the second enclosure may be interconnected by a connecting passageway capable of permitting flow of gas therebetween, and the water sprays may comprise one or more water spray nozzles mounted in the second enclosure operable to spray a fine mist into that enclosure adjacent the steel strip while tending to avoid liquid water from contacting the steel strip, to generate steam and increase the level of hydrogen gas in both enclosures.

In the described method, the cast steel strip may be delivered to a hot rolling mill in which it is hot rolled as it is produced. The strip may exit the second enclosure before entering the rolling mill, and in this embodiment, may comprise a pair of mill rolls between which the strip passes to exit the second enclosure. However, the strip may remain within the second enclosure as it enters into the rolling mill, or the rolling mill may be positioned between the first and second enclosures. This positioning of the rolling mill may be achieved by sealing the second enclosure against mill rolls or a housing of the rolling mill.

DESCRIPTION OF THE DRAWINGS

In order to more fully explain, particular embodiments will be described in detail with reference to the accompanying drawings in which.

DETAILED DESCRIPTION

Figure 1:
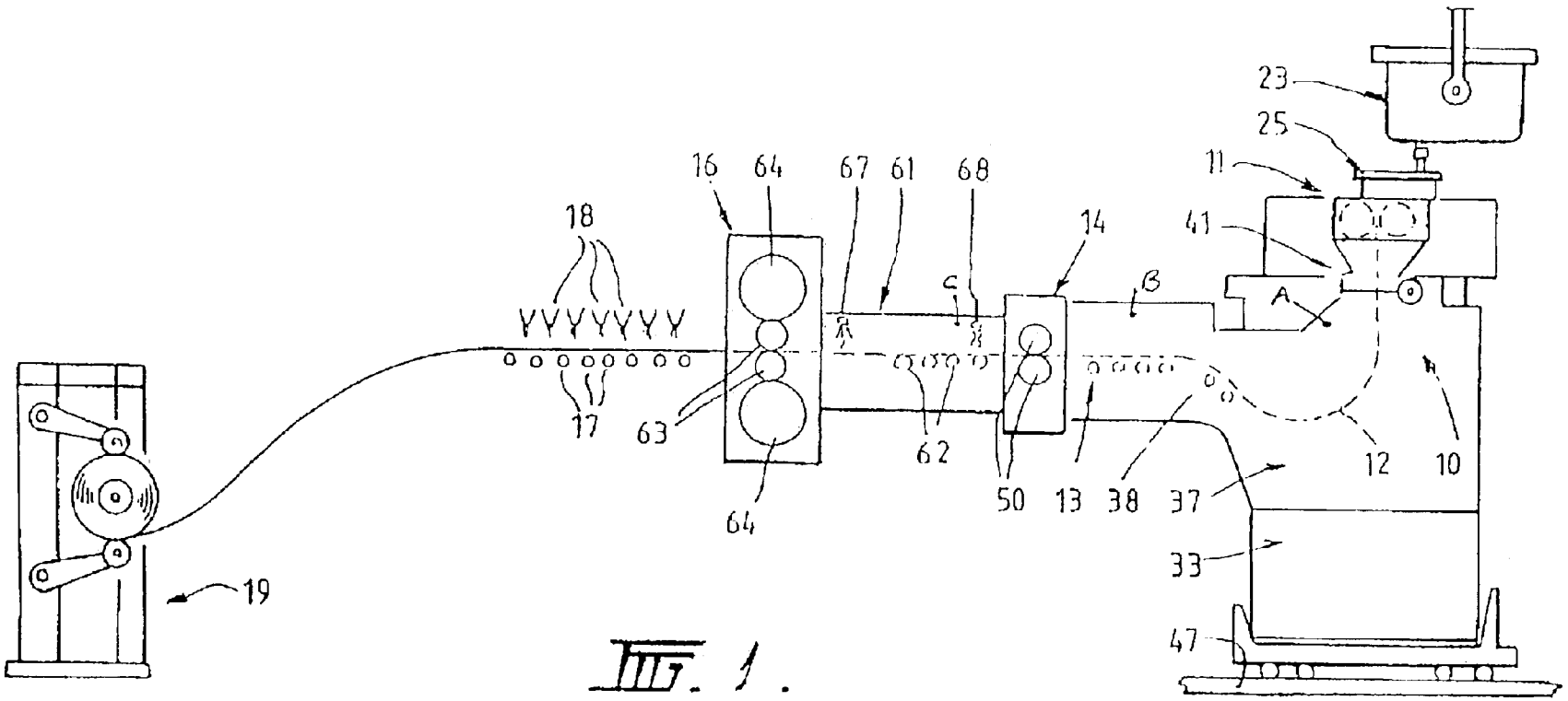
FIG. 1 is a vertical cross-section through a steel strip casting and rolling installation constructed and operated in accordance with the present invention.
Figure 2:
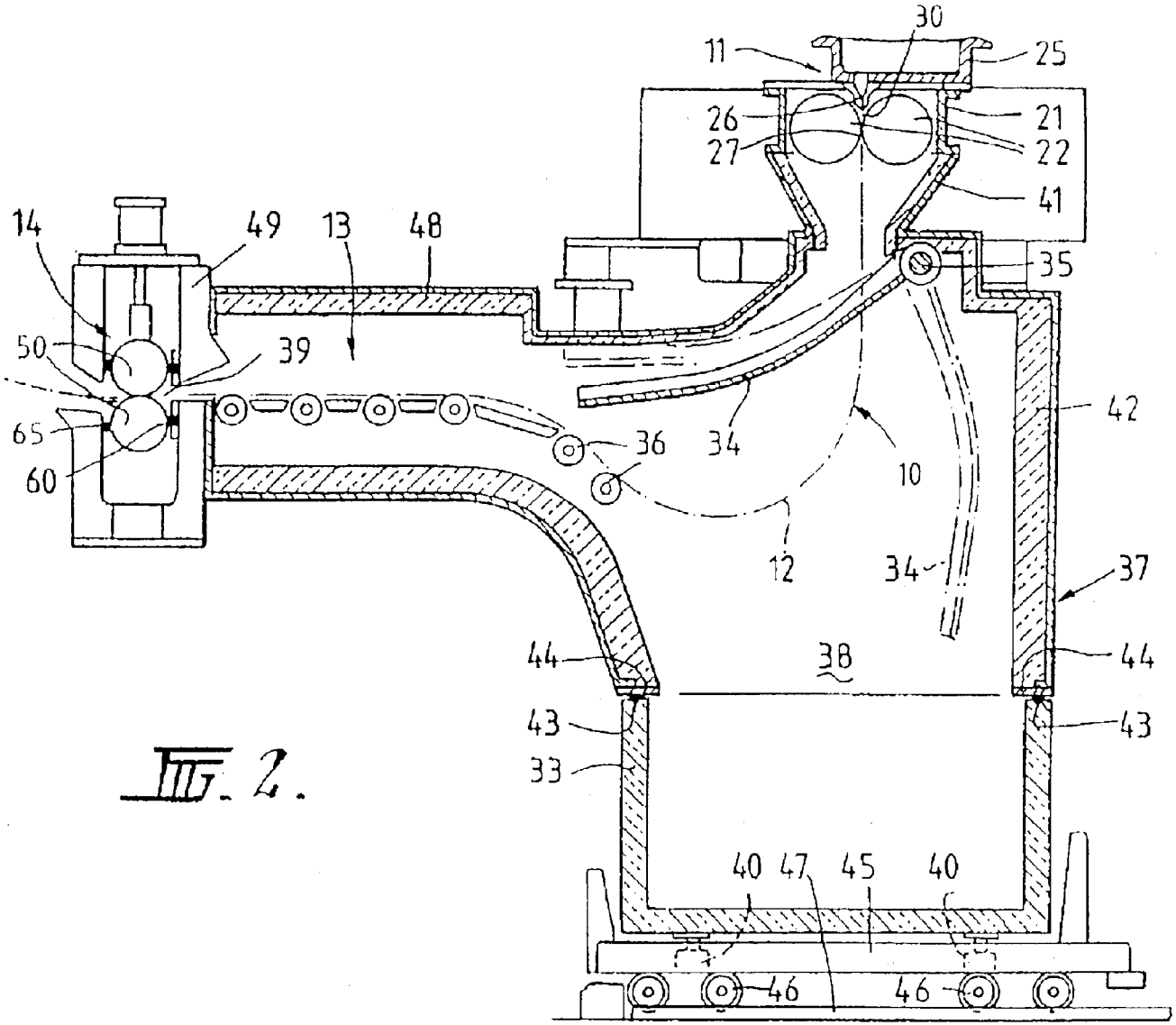
FIG. 2 illustrates essential components of a twin roll caster incorporated in the installation and including a first hot strip enclosure.
Figure 3:
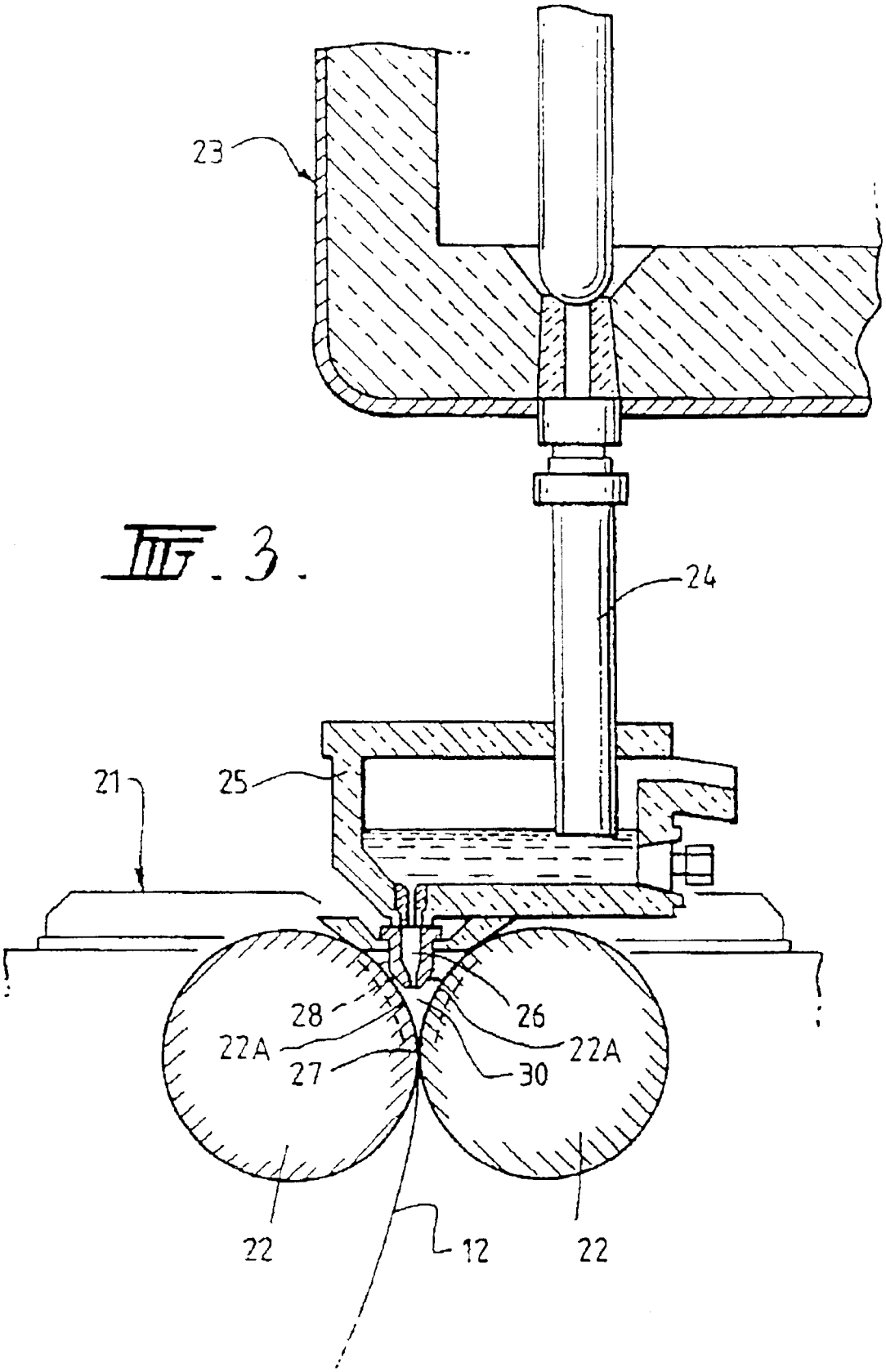
FIG. 3 is a vertical cross-section through the twin roll caster.
Figure 4:
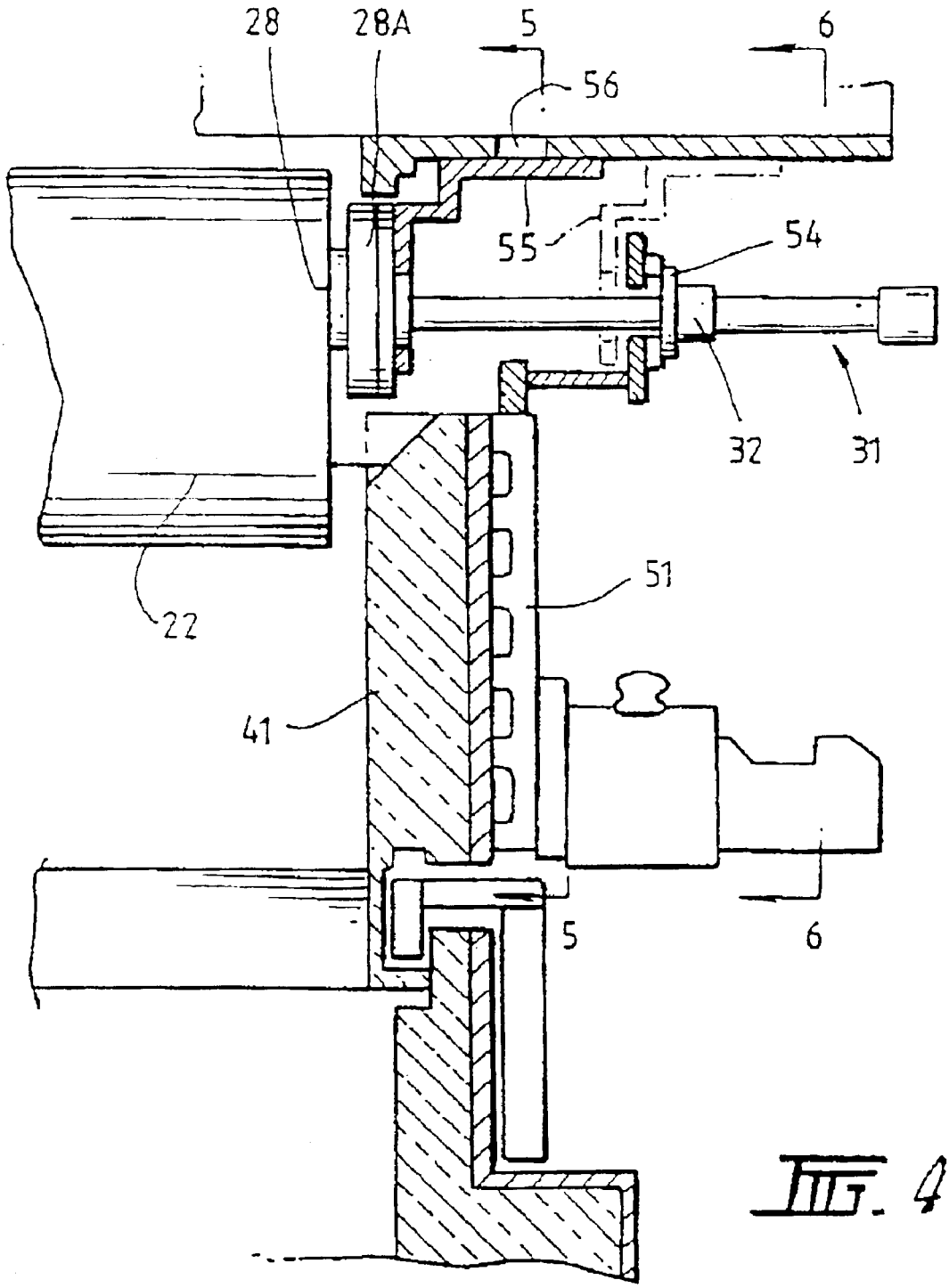
FIG. 4 is a cross-section through end parts of the caster.
Figure 5:
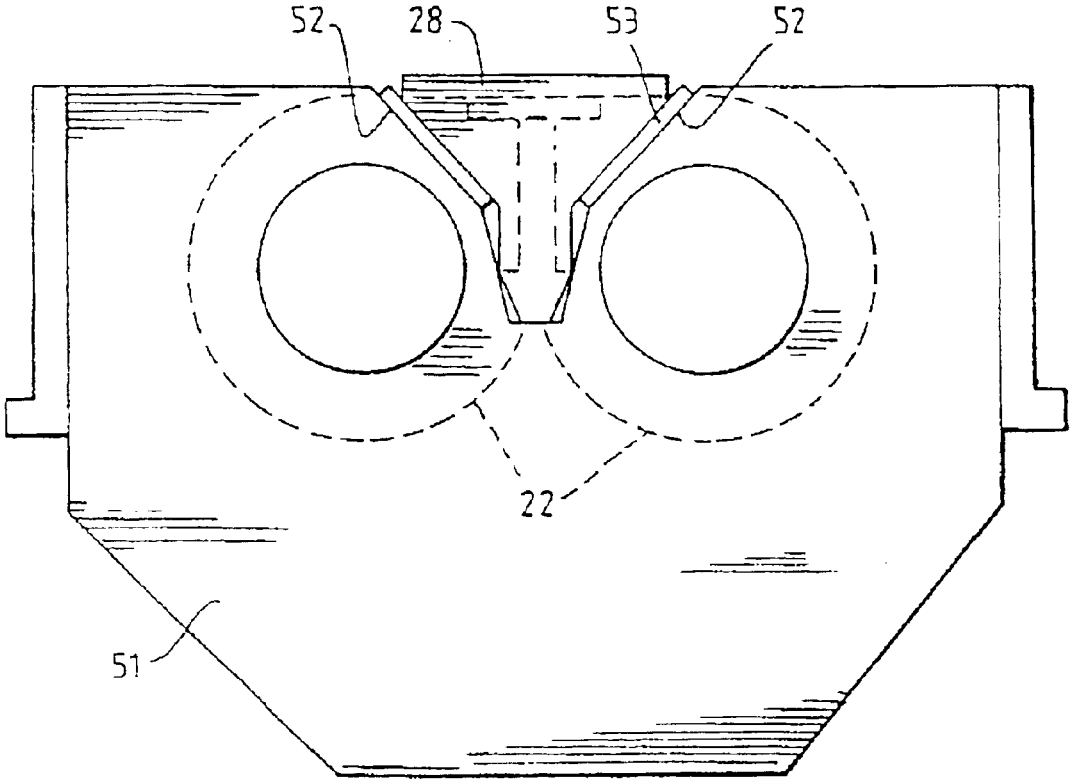
FIG. 5 is a cross-section on the line 5—5 in FIG. 4.
Figure 6:
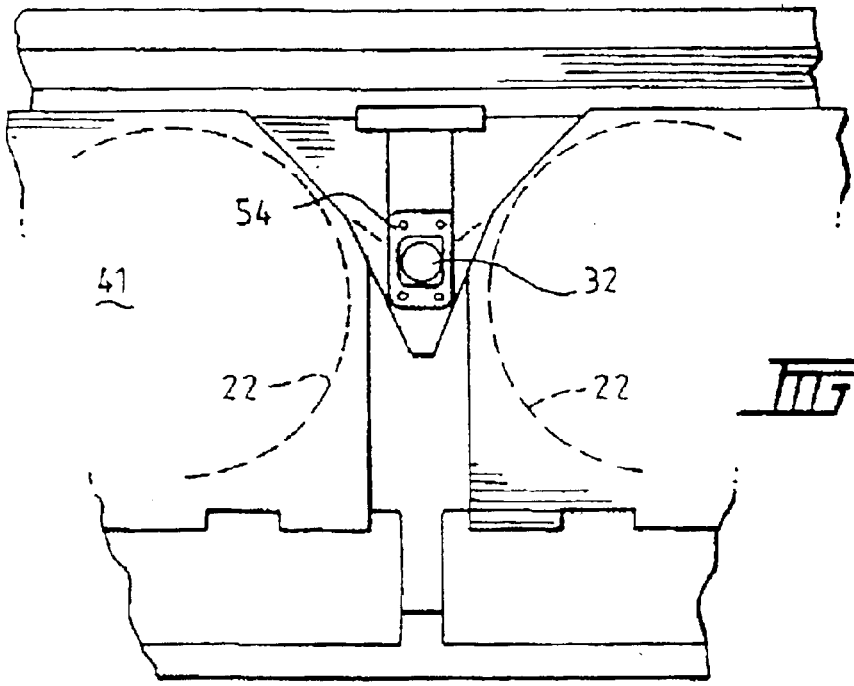
FIG. 6 is a view on the line 6—6 in FIG. 4.
Figure 7:
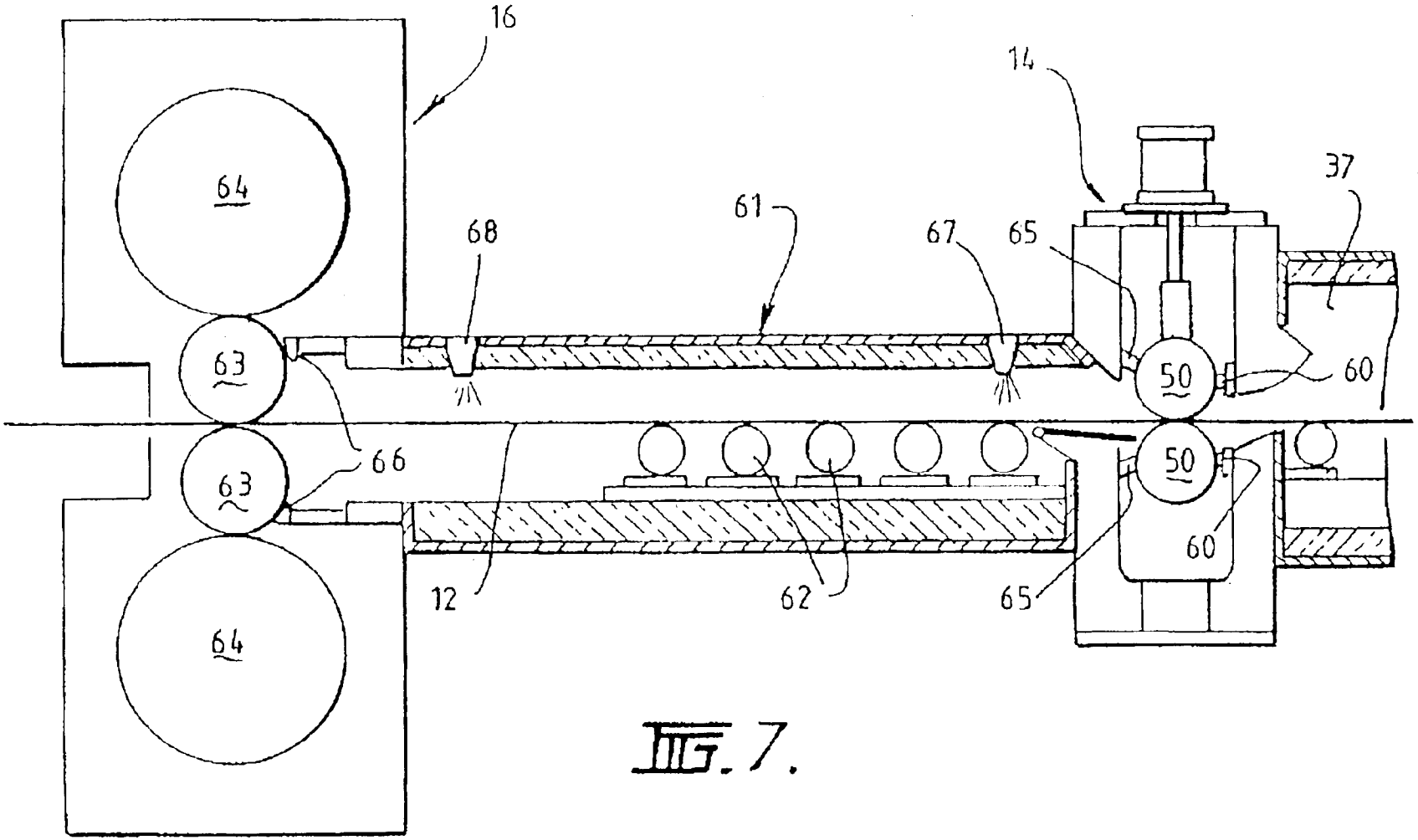
FIG. 7 illustrates a section of the installation downstream from the caster which includes a second strip enclosure and an in-line rolling mill.

The casting and rolling installation illustrated in FIGS. 1 to 7 comprises a twin roll caster denoted generally as 11 that produces a cast steel strip 12 which passes in a transit path 10 across a guide table 13 to a pinch roll stand 14. After exiting the pinch roll stand 14, the strip passes to a hot rolling mill 16 in which it is hot rolled to reduce its thickness. The rolled strip exits the rolling mill and passes to a run out table 17 on which it may be force cooled by a fine mist from water jets 18 and thence to a coiler 19.

Twin roll caster 11 comprises a main machine frame 21 which supports a pair of parallel casting rolls 22 having casting surfaces 22A. Molten metal is supplied during a casting operation from a ladle 23 through a refractory ladle outlet shroud 24 to a tundish 25 and thence through a metal delivery nozzle 26 above the nip 27 between the casting rolls 22. Molten metal thus delivered forms a casting pool 30 supported on the casting surface 22A of the casting rolls 22. This casting pool 30 is confined at the ends of the rolls by a pair of side closure dams or plates 28 which are applied to stepped ends of the rolls by a pair of thrusters 31 comprising hydraulic cylinder units 32 connected to side plate holders 28A. The upper surface of casting pool 30 (generally referred to as the meniscus level) may rise above the lower end of the delivery nozzle 26 so that the lower end of the delivery nozzle is immersed within this casting pool.

Casting rolls 22 are internally water cooled so that metal shells solidify on the moving casting surfaces of the casting rolls and are brought together at the nip 27 between the rolls to produce the cast strip 12, which is delivered downwardly from the nip between the rolls.

At the start of a casting operation, a short length of imperfect strip is produced as the casting conditions stabilize. After continuous casting is established, the casting rolls are moved apart slightly and then brought together again to cause this leading end of the strip to break away in the manner described in Australian Patent Application 27036/92 so as to form a clean head end of the following cast strip. The imperfect material drops into a scrap box 33 located beneath caster 11, and at this time, a swinging apron 34, which normally hangs downwardly from a pivot 35 to one side of the caster outlet, is swung across the caster outlet to guide the clean end of the cast strip onto the guide table 13 from where it is fed to the pinch roll stand 14. Apron 34 is then retracted back to its hanging position to allow the strip 12 to hang in a loop beneath the caster before it passes to the guide table 13 where it engages a succession of guide rollers 36.

The twin roll caster may be of the kind which is illustrated and described in some detail in granted Australian Patents 631728 and 637548 and U.S. Pat. Nos. 5,184,668 and 5,277,243 and reference may be made to those patents for appropriate constructional details which form no part of the present invention.

Between the casting rolls and pinch roll stand 14, the newly formed steel strip is enclosed within a first enclosure denoted generally as 37 defining a sealed space or atmosphere 38 adjacent the casting surfaces 22A of casting rolls 22. First enclosure 37 is formed by a number of separate wall sections which fit together at various seal connections to form a continuous enclosure wall. The enclosure 37 is comprised of a wall section 41 which is formed at the twin roll caster to enclose the casting rolls, and an enclosure wall 42, which may extend downwardly beneath wall section 41, to engage the upper edges of scrap box 33 when the scrap box is in its operative position. The scrap box and enclosure wall 42 may be connected by a seal 43 formed by a ceramic fiber rope fitted into a groove in the upper edge of the scrap box and engaging flat sealing gasket 44 fitted to the lower end of wall section 42. Scrap box 33 may be mounted on a carriage 45 fitted with wheels 46 which run on rails 47 whereby the scrap box can be moved after a casting operation to a scrap discharge position. Screw jack units 40 are operable to lift the scrap box from carriage 45 when it is in the operative position so that it is pushed against the enclosure wall 42 and compresses the seal 43. After a casting operation the jack units 40 are released to lower the scrap box onto carriage 45 to enable it to be moved to the scrap discharge position.

First enclosure 37 further comprises a wall section 48 disposed about the guide table 13 and connected to the frame 49 of pinch roll stand 14 which includes a pair of pinch rolls 50 against which enclosure 37 is sealed by sliding seals 60. Accordingly, the strip exits the first enclosure 37 by passing between the entry nip 39 of the pair of pinch rolls 50 and passes into a second enclosure denoted generally as 61 through which the strip passes to the hot rolling mill 16. Most of the first enclosure wall sections may be lined with fire brick and the scrap box 33 may be lined either with fire brick or with a castable refractory lining. Alternatively, all or parts of the first enclosure wall sections may be formed by internally water cooled metal panels. The enclosure wall section 41 which surrounds the casting rolls is formed with side plates 51 provided with notches 52 shaped to snugly receive the side dam plate holders 28A when the side dam plates 28 are pressed against the ends of the rolls by the cylinder units 32. The interfaces between the side plate holders 28A and the enclosure side wall sections 51 are sealed by sliding seals 53 to maintain sealing of first enclosure 37. Seals 53 may be formed of ceramic fiber rope.

The cylinder units 32 extend outwardly through the enclosure section 41 and at these locations first enclosure 37 is sealed by sealing plates 54 fitted to the cylinder units so as to engage with the enclosure wall section 41 when the cylinder units are actuated to press the side plates against the ends of the rolls. Thrusters 31 also move refractory slides 55 which are moved by the actuation of the cylinder units 32 to close slots 56 in the top of first enclosure 37 through which the side plates are initially inserted into the enclosure and into the holders 28A for application to the rolls. The top of first enclosure 37 is closed by the tundish, the side plate holders 28A and the slides 55 when the cylinder units are actuated to apply the side dam plates against the rolls. In this way the complete enclosure 37 is sealed prior to a casting operation to establish the sealed space 38 adjacent the casting surfaces 22A of casting rolls 22.

The second enclosure 61 may be separate from the first enclosure 37, where the strip can be held in a separate atmosphere in second enclosure 61 up to the hot rolling mill 16. Rolling mill 16 contains a series of pass line rollers 62 to guide strip horizontally through second enclosure 61 to the work rolls 63 of rolling mill 16 which are disposed between two larger backing rolls 64. Second enclosure 61 is sealed at one end against pinch rolls 50 by sliding seals 65, and at the other end, it is sealed against the working rolls 63 of rolling mill 16 by sliding seals 66. The sliding seals 65 and 66 could be replaced by rotary sealing rolls to run or the strip in the vicinity of the pinch rolls and reduction rolls, respectively.

Second enclosure 61 is fitted with a pair of water spray nozzles 67 and 68 that are each operable to spray a fine mist of water droplets adjacent the surface of the steel strip as it passes through the second enclosure, and thereby to generate steam within the second enclosure while tending to avoid liquid water contact with the steel strip. Spray nozzle 67 is mounted in the roof of enclosure 61 downstream from the pinch roll stand 14. Nozzle 68 is located at the other end of enclosure 61 in advance of the rolling mill 16. The nozzles 67 and 68 may be standard commercially available mist spray nozzles operable with a gas propellant to produce a fine mist of water. In the illustrative method of the present invention the gas propellant may be an inert gas such as nitrogen. In a typical installation the nozzles will be operated under nitrogen at a pressure of around 400 kPa. The water may be supplied at around 100–500 kPa pressure, although the pressure of the water is not critical. The nozzles are set up to produce a fine mist spray across the width of the strip to generate steam within the second enclosure 61.

In operation of the illustrated caster, both of first enclosure 37 and second enclosure 61 may initially be purged with nitrogen gas prior to commencement of casting. Prior to casting, the water sprays are activated so that as soon as the hot strip passes into second enclosure 61 steam is generated within that enclosure so as to produce a positive pressure preventing ingress of atmospheric air. The supply of nitrogen may be terminated after commencement of casting. Initially the cast strip will take up all of the oxygen from the first enclosure 37 to form heavy scale on the strip. However, the sealing of space 38 of first enclosure 37 controls the ingress of oxygen containing atmosphere below the amount where substantial amounts of oxygen are taken up by the steel strip. Thus, after an initial start up period the oxygen content in the first enclosure 37 will remain depleted and limiting the availability of oxygen for oxidizing of the strip. In this way, the formation of scale on the cast strip is controlled without the need to maintain a supply of nitrogen to space 38 of the first enclosure 37.

As previously described, pinch roll 14 is provided with sliding seals 60, 65 to slide on the pinch rolls 50 at the division between first and second enclosures 38 and 61. The pinch rolls and seals are effective to prevent a back flow of liquid water from second enclosure 61 but pinch roll stand 14 provides a gas flow passageway around the two ends of the pinch rolls 50 by which gas can flow from the second enclosure 61 to the first enclosure 38. It has been found in operation of the apparatus that the intercommunication between the two enclosures by this interconnecting passageway is quite sufficient to permit increased levels of hydrogen to flow from the second enclosure 61 into the first enclosure 37. This is shown by the following results obtained by operation of a twin roll casting and rolling installation as illustrated in the drawings and testing with and without the operation of the fine mist water sprays 67 and 68. Gas sampling of the atmosphere within both the first enclosure 37 and the second enclosure 61 was carried out at the locations A, B and C indicated in FIG. 1 with the following gas analyses reported in Table 1 below. The remainder of the gas in the atmospheres analyzed is nitrogen gas ($N_2$).

TABLE 1

| | Oxygen ($O_2$) (vol %) | Water ($H_20$) (vol %) | Hydrogen ($H_2$) (vol %) | Carbon Monoxide (CO) (vol %) | Carbon Dioxide ($CO_2$) (vol %) |
|---|---|---|---|---|---|
| Casting Pool | 0.2 | 0.11 | 0.10 | 0.05 | <0.01 |
| A First Encl | 2.5–1.0 | 2.25–0.6 | 0.4–0.15 | 0.2–0.0 | 0.36–0.06 |
| B First Encl | 3.0–1.0 | 2.1–0.3 | 0.4–0.1 | 0.13–0.0 | 0.2–0.0 |
| C Sec'd Encl | 0.5 | 1.6–0.7 | 0.5–0.31 | 0.08–0.0 | 0.01–0.0 |

It will be seen that the levels hydrogen within the first enclosure 37, although smaller than the levels in the second enclosure 61, are still increased substantially by operation of the fine mist water nozzles in the second enclosure 61. The increased levels of hydrogen in both the first and second enclosures 37, 61 are associated with a marked reduction in oxygen content and dramatically reduce scale formation. It is further seen that there are elevated humidity levels in both the first and second enclosures indicating the presence of steam, and both enclosures are under positive pressure by the presence of steam. The increased hydrogen level may be explained by catalytic reaction of water molecules in the fine mist under the high temperature conditions surrounding the steel strip within the second enclosure to form hydrogen gas. Oxygen gas simultaneously formed from water molecules is taken up by oxidizing of the strip during initial passage of the strip through the second enclosure, so that a substantial quantity of hydrogen gas is generated. Subsequent oxidation of the strip is suppressed by the hydrogen gas and the positive pressure within the second enclosure which limits ingress of atmospheric air, but is sufficient to maintain the hydrogen content in the second enclosure and to produce a very thin layer of scale on the strip which has been found to be desirable on hot rolling to avoid sticking in the roll bite. It has been found that the very thin layer of scale produced in the extremely moist atmosphere in second enclosure 61 serves as a strongly adherent lubricant which minimizes roll wear and operational difficulties at the rolling mill. At the same time, because the fine mist spray is generated into steam in the second enclosure, contact of the steel strip with liquid water tends to be avoided and the prospect of uneven cooling of the strip is substantially reduced if not eliminated.

Figure 8:
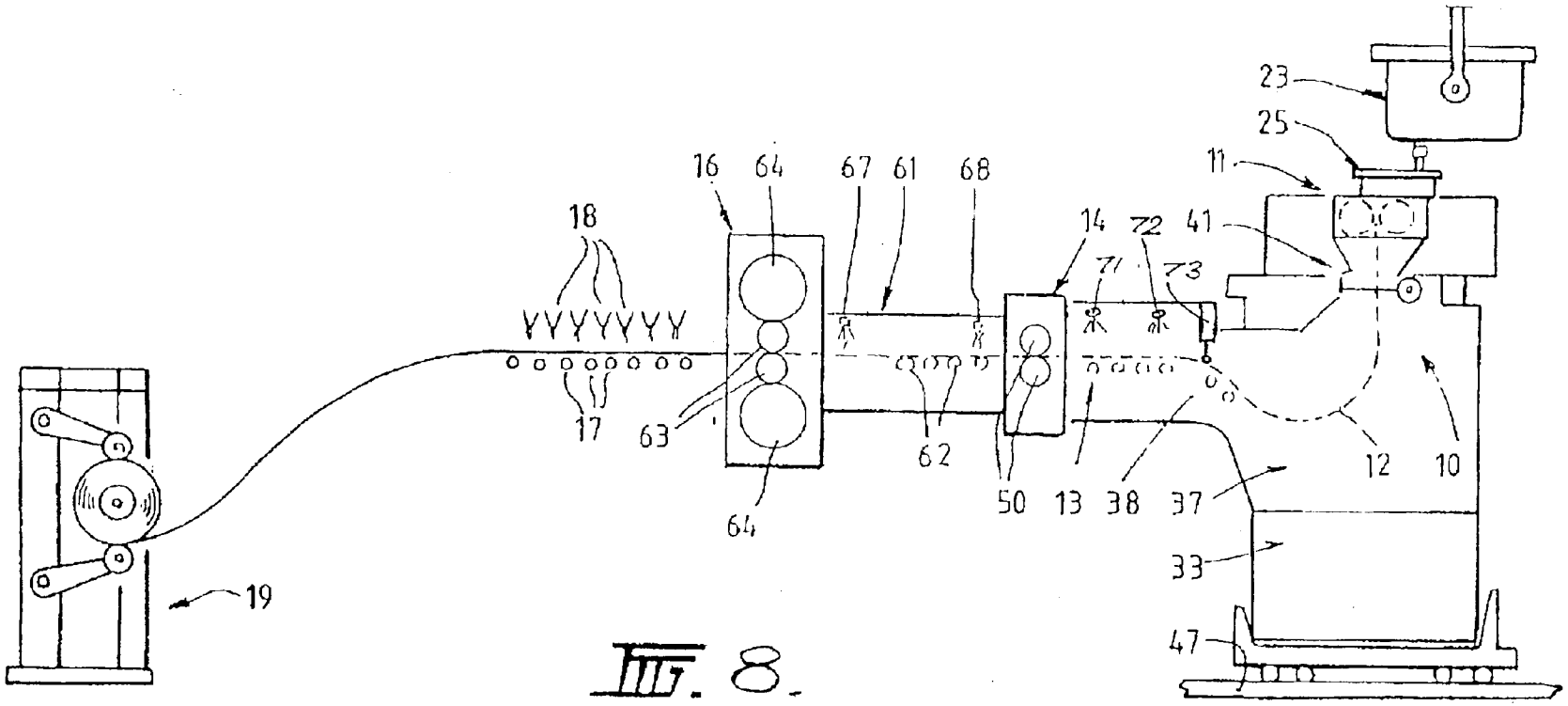
FIG. 8 illustrates a modified embodiment which incorporates additional water mist sprays.

FIG. 8 illustrates a modification to the casting and rolling installation by which additional water spray nozzles 71, 72 are arranged to generate a fine water mist spray in the first enclosure 37. Apart these additional spray nozzles, the installation illustrated in FIG. 8 is the same as previously described. Accordingly, the other components have been identified in FIG. 8 by the same reference numerals as in FIG. 1. Spray nozzles 71, 72 are similar to the nozzles 67, 68 and may be operated in similar fashion and under the same conditions to spray a fine water mist adjacent the surface of strip 12 while attending to avoid liquid water contact with the strip. Further, spray nozzles 71, 72 are positioned toward the exit end of enclosure 37 to minimize the possibility of liquid water coming into contact with the casting surfaces 22A of casting rolls 22. A curtain gate seal may be installed at a location between the spray nozzles 71, 72 and the casting rolls as indicated at 73 to further minimize this risk.

It is also shown from FIG. 8 that the operation with increased levels of hydrogen gas in first enclosure 37 can be achieved by the fine mist spray from nozzles 71, 72 without the operation of nozzles 67, 68 in the second enclosure 61, and without the presence of second enclosure 61.

What is claimed is:

1. A method of continuously casting steel comprising:

(a) forming a casting pool of molten steel on chilled casting surfaces of at least one casting roll;

(b) moving the chilled casting surfaces to produce a cast steel strip moving away from the casting pool;

(c) guiding the cast strip through a first enclosure adjacent the casting surfaces, and optionally thereafter through a second enclosure, as the strip moves away from the casting pool;

(d) sealing the first enclosure and, if present, the second enclosure against ingress of atmospheric air; and (e) introducing water into at least one of said enclosures in form of fine mist to produce an increased level of hydrogen gas within the first enclosure while avoiding liquid water contact with the steel strip.

2. The method as described in claim 1 where the first and second enclosures are separately sealed and the water is introduced into the first enclosure in form of fine mist to produce an increased level of hydrogen gas within the first enclosure while avoiding liquid water contact with the steel strip.

3. The method as described in claim 1 where water is introduced into the second enclosure in form of fine mist to produce an increased level of hydrogen gas within the second enclosure while avoiding liquid water contact with the steel strip, and comprising in addition the step of flowing gas with an increased level of hydrogen from the second enclosure to the first enclosure.

4. Apparatus for casting steel strip comprising:

(a) a pair of generally horizontal-positioned casting rolls forming a nip therebetween;

(b) a metal delivery system to deliver molten steel above the nip between the casting rolls to form a casting pool of molten steel supported on the casting rolls;

(c) a cooling system to internally cool the casting rolls;

(d) a drive system to counter-rotate the casting rolls in opposite directions;

(e) said casting rolls having cooled casting surfaces to produce a cast strip delivered downwardly from the nip;

(f) a first enclosure adjacent the casting rolls through which the cast strip passes on a transit path away from the nip;

(g) optionally a second enclosure through which the cast strip passes after the cast strip has passed through the first enclosure;

(h) enclosure seals sealing the first enclosure and, if present, the second enclosure; and (i) at least one water spray operable to spray water in form of a fine mist into at least one of said enclosures to produce an increased level of hydrogen gas within the first enclosure while avoiding liquid water contact with the steel strip.

5. The apparatus as described in claim 4 wherein the first enclosure and, if present, the second enclosure are separately sealed, and the water spray is capable of spraying water into the first enclosure in form of fine mist to produce an increased level of hydrogen gas within the first enclosure while avoiding liquid water contact with the steel strip.

6. The apparatus as described in claim 4 wherein the water spray is capable of spraying water into the second enclosure in the form of fine mist to produce an increased level of hydrogen gas within the second enclosure while avoiding liquid water contact with the steel strip, and the first enclosure and the second enclosure are sealed with an interconnecting passageway between the enclosures to allow gas to flow from the second enclosure to the first enclosure to produce an increased level of hydrogen gas within the first enclosure.

7. The apparatus as described in claim 4 comprising in addition strip guides to guide the strip delivered downwardly from the nip through a transit path in the first enclosure and through a transit path in the second enclosure, if the second enclosure is present.

8. The apparatus as described in claim 6 comprising in addition strip guides to guide the strip delivered downwardly from the nip through a transit path in the first enclosure and through a transit path in the second enclosure, if the second enclosure is present.

9. A method of continuously casting steel strip comprising:

supporting a casting pool of molten steel on one or more chilled casting surfaces;

moving the chilled casting surface or surfaces to produce a solidified steel strip moving away from the casting pool;

providing a first enclosure and a second enclosure to surround the solidified steel strip as the strip moves away from the casting pool such that the strip can be exposed to separate atmospheric conditions in the first enclosure and thereafter the second enclosure;

sealing the first and second enclosures to restrict ingress of atmospheric air;

passing the solidified strip through the first enclosure and thereafter the second enclosure; and introducing water into the second enclosure to produce an increased level of hydrogen gas within the second enclosure while avoiding liquid water contact with the steel strip.

10. A method as claimed in claim 9, wherein the strip exits the first chamber at a temperature in the range of about 3000° C. to 1150° C.

11. A method as claimed in claim 9, wherein the water is introduced through one or more fine mist sprays directed along at least one face of the steel strip as the strip passes through the second enclosure.

12. A method as claimed in claim 11, wherein the water is introduced through the one or more mist sprays directed downwardly toward the upper face of the steel strip.

13. A method as claimed in claim 11, wherein in order to produce the spray mist, the water is forcibly propelled by a gas propellant through one or more mist spray nozzles.

14. A method as claimed in claim 13, wherein the gas propellant is an inert gas.

15. A method as claimed in claim 13, wherein the gas propellant is nitrogen.

16. A method as claimed in claim 9, wherein the strip is passed from the first enclosure to the second enclosure through a pair of pinch rolls.

17. A method as claimed in claim 16, wherein the pinch rolls are operated to reduce the strip thickness by up to 5%.

18. A method as claimed in claim 9, wherein the first and second enclosures are initially purged with an inert gas before commencement of casting of said strip so as to reduce the initial oxygen content within the enclosures.

19. A method as claimed in claim 18, wherein the purging reduces the initial oxygen content within the enclosures to between about 5% to 10%.

20. A method as claimed in claim 19, wherein the purging gas is nitrogen.

21. A method as claimed in claim 18, wherein during casting of said strip the first enclosure is continuously charged with inert gas.

22. A method as claimed in claim 18, wherein during casting of said strip the oxygen content in the first enclosure is maintained at a level less than the surrounding atmosphere by continuous oxidation of the strip passing therethrough.

23. A method as claimed in claim 9, wherein the solidified strip is delivered to a hot rolling mill in which it is hot rolled as the strip is produced.

24. A method of continuously casting steel strip comprising:

supporting a casting pool of molten steel on one or more chilled casting surfaces;

moving the chilled casting surface or surfaces to produce a solidified steel strip moving away from the casting pool;

providing a first enclosure and a second enclosure to surround the solidified steel strip as the strip moves away from the casting pool such that the strip can be exposed to separate atmospheric conditions in the first enclosure and thereafter the second enclosure;

sealing the first and second enclosures to restrict ingress of atmospheric air;

passing the solidified strip through the first enclosure and thereafter the second enclosure; and introducing water into the second enclosure to produce an increased level of hydrogen gas within the second enclosure while tending to avoid liquid water contact with the steel strip;

wherein the solidified strip is delivered to a hot rolling mill in which it is hot rolled as the strip is produced; and wherein the hot rolling mill is disposed at the exit to the second enclosure and seals that enclosure so as to hot roll the strip as it exits the second enclosure.

25. Apparatus for casting steel strip comprising:

a pair of generally horizontal casting rolls forming a nip between them;

a metal delivery system to deliver molten steel into the nip between the casting rolls to form a casting pool of molten steel supported on the rolls;

a cooling system to chill the casting rolls;

a drive system to rotate the casting rolls in mutually opposite directions to produce a cast strip delivered downwardly from the nip;

at least one strip guide to guide the strip delivered downwardly from the nip through a transit path which takes it away from the nip;

a first enclosure sealed to control ingress of atmospheric air and surrounding the strip through at least part of said transit path;

a second enclosure separate from the first enclosure also sealed to control ingress of atmospheric air and capable of receiving the strip after it has passed through the first enclosure; and at least one water spray operable to spray water into the second enclosure to produce an increased level of hydrogen gas within the second enclosure while avoiding liquid water contact with the steel strip.

26. Apparatus as claimed in claim 25, wherein the at least one water spray comprises one or more water mist spray nozzles mounted with the second enclosure.

27. Apparatus as claimed in claim 25, wherein the one or more spray nozzles are disposed so as to spray water mist toward an upper face of the steel strip.

28. Apparatus as claimed in claim 25, wherein the first and second enclosures are separated from one another by a pair of pinch rolls.

29. Apparatus as claimed in claim in claim 28, wherein the pinch rolls are operable to reduce the strip thickness.

30. Apparatus as claimed in claim 25, and further comprising a hot rolling mill disposed so as to hot roll the strip as it is produced.

31. Apparatus for casting steel strip comprising:

a pair of generally horizontal casting rolls forming a nip between them;

a metal delivery system to deliver molten steel into the nip between the casting rolls to form a casting pool of molten steel supported on the rolls;

a cooling system to chill the casting rolls;

a drive system to rotate the casting rolls in mutually opposite directions to produce a cast strip delivered downwardly from the nip;

at least one strip guide to guide the strip delivered downwardly from the nip through a transit path which takes it away from the nip;

a first enclosure sealed to control ingress of atmospheric air and surrounding the strip through at least part of said transit path;

a second enclosure separate from the first enclosure also sealed to control ingress of atmospheric air and capable of receiving the strip after it has passed through the first enclosure;

at least one water spray operable to spray water into the second enclosure to produce an increased level of hydrogen gas within the second enclosure while avoiding liquid water contact with the steel strip;

a hot rolling mill disposed so as to hot roll the strip as it is produced; and wherein the hot rolling mill is disposed at the exit to the second enclosure and seals that enclosure so as to hot roll the strip as it exits the second enclosure.

* * * * *